United States Patent [19]

Hlasnicek et al.

[11] 4,177,985

[45] Dec. 11, 1979

[54] JUMP ROPE WITH VARIABLE WEIGHTING AND ROPE CONFIGURATION

[76] Inventors: Richard S. Hlasnicek; Jean F. Hlasnicek, both of Jamestown Star Rte., Boulder Heights, Colo. 80302

[21] Appl. No.: 838,917

[22] Filed: Oct. 3, 1977

[51] Int. Cl.[2] ..... A63B 5/20

[52] U.S. Cl. ..... 272/75

[58] Field of Search ..... 272/75, 74

[56] References Cited

U.S. PATENT DOCUMENTS

| | | | |
|---|---|---|---|
| 674,431 | 5/1901 | Black | 272/75 |
| 2,723,121 | 11/1955 | Cartwright et al. | 272/75 |
| 2,869,872 | 1/1959 | Nissen | 272/75 |
| 3,517,931 | 6/1970 | Kalish | 272/75 |
| 3,642,277 | 2/1972 | Gersten | 272/75 |
| 3,745,694 | 7/1973 | Vennola | 272/75 UX |
| 3,762,704 | 10/1973 | Gingras | 272/75 |
| 3,850,429 | 11/1974 | Clifford | 272/142 |

FOREIGN PATENT DOCUMENTS

| | | | |
|---|---|---|---|
| 816571 | 7/1969 | Canada | 272/74 |
| 164848 | 9/1958 | Sweden | 272/75 |

*Primary Examiner*—Richard C. Pinkham
*Assistant Examiner*—Arnold W. Kramer
*Attorney, Agent, or Firm*—Kyle W. Rost

[57] ABSTRACT

A segmented jump rope having handles is provided with soft, flexible sleeves overlappable with the handles and slidable to the center of the rope. The sleeves may have abutting ends, or one sleeve may be configured to mate within the adjacent end of the other. The segments of the rope are shorter than either sleeve, but the central segments may be longer and of greater diameter than the others for improved interaction with the sleeves to straighten the central arc of the rope.

7 Claims, 9 Drawing Figures

JUMP ROPE WITH VARIABLE WEIGHTING AND ROPE CONFIGURATION

BACKGROUND OF THE INVENTION

1. Field of the Invention

The invention relates to amusement and exercise devices. Specifically, the invention is an improved jump rope.

2. Description of the Prior Art

Jump ropes consisting of a length of rope or cable with handles on the ends thereof are well known. The prior art includes U.S. Pat. No. 2,723,121 to Cartwright et al., which teaches the use of cylindrical sleeves on the central part of the rope for the purpose of protecting the rope from wear against the ground and for weighting the center of the rope. U.S. Pat. No. 3,642,277 to Gersten teaches the use of cylinders over the entire length of rope for the purpose of limiting the flexibility of the rope to prevent injury to children, who might loop such a rope around another child's neck during play. U.S. Pat. No. 3,762,704 to Gringras teaches a rope formed entirely of cylinders that telescope together for compact storage of the toy.

The present invention is an improvement over prior ropes with cylinders thereon. Such ropes offer only a single predetermined degree of weighting and limited flexibility, while persons who jump rope as a means of serious exercise can benefit from selectively variable weighting. Additionally, a jump rope can be made more versatile through provision for rigidity at the center of the rope.

SUMMARY OF THE INVENTION

A jump rope of the kind having segmented construction with handles on the ends thereof is provided with sleeves that fit over the handles to increase the size thereof. The sleeves may be released from the handles during jumping exercise, where centrifugal force will cause the sleeves to slide to the center of the rope. The sleeves may be equipped with means thereon for mating the ends of the sleeves when they meet at the center of the rope, thereby maintaining the sleeves in axial alignment and straightening the central arc of the rope. The rope segments are of a size shorter than the sleeves and preferably are odd in number so that a central segment will pass through the junction of the sleeves to increase its straightness and segment portions will extend beyond the outer ends of the sleeves. The central segment and segments adjacent thereto may be of longer length and greater diameter than other segments of the rope to interact with the interior of the sleeves to additionally straighten the center of the rope.

The primary object of the invention is to create a jump rope having selectively variable central weighting that allows a user to add the inertia of additional mass at the center of the rope while exercise continues uninterrupted.

Another important object of the invention is to create a jump rope that can have its central arc straightened, thereby reducing the effective length of the rope and altering the pattern of continuing exercise.

A further object is to create a segmented jump rope that has cushioned, flexible handles that can be released to move to the center of the rope, where the handles will interact with segmented links of the rope, the handles and links mutually reinforcing each other to form a straight central section of rope that can resist forces urging the rope to form a central arc.

DESCRIPTION OF THE PREFERRED EMBODIMENT

In the embodiment shown in FIGS. 1-9, a jump rope 10 is formed from an elongated central core 12 of flexible rope, cable or the like, and the body of the jump rope core is covered for substantially its entire length with a plurality of cylindrical links 14. At opposite ends of the jump rope are handles 16 in which the core is fastened by any conventional means, for example by knotting the ends at 18. Jump ropes of this type and variations thereof are well known in the art and need not be described in greater detail.

Figure 1:
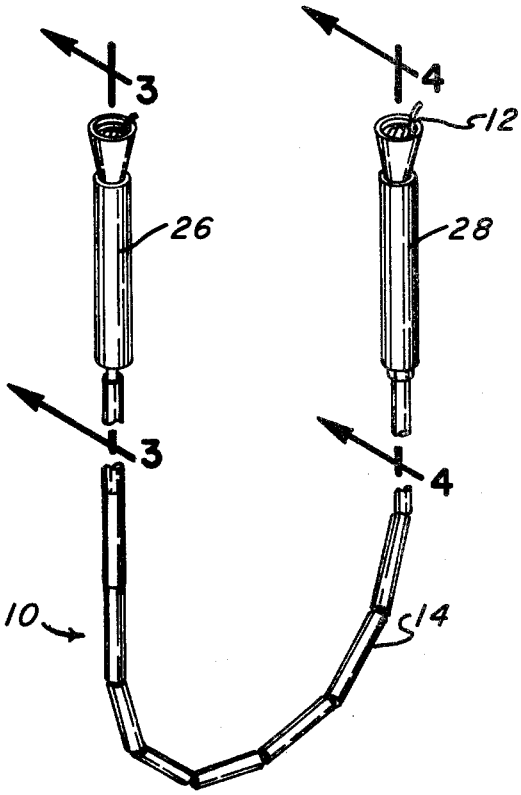
FIG. 1 is an isometric view of the rope with sleeves overlapping the handles.
Figure 2:
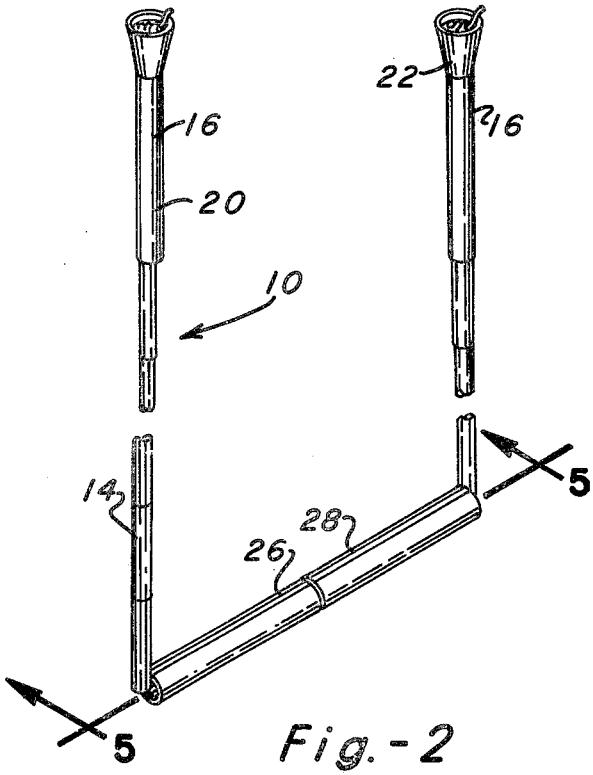
FIG. 2 is an isometric view of the rope with sleeves at the center of the rope.
Figure 3:
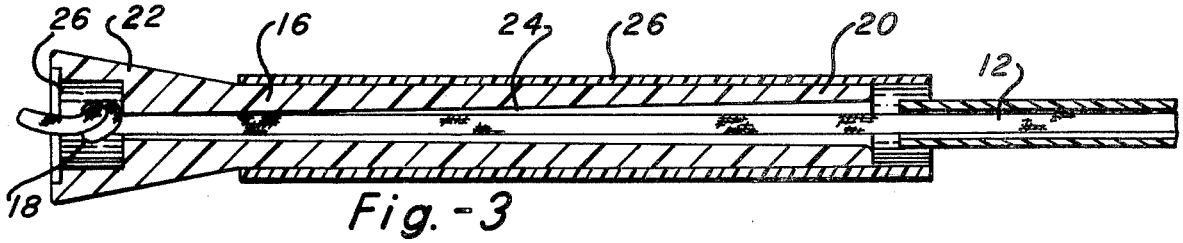
FIG. 3 is a cross-sectional view of the rope taken along the plane of line 3—3 of FIG. 1.
Figure 4:
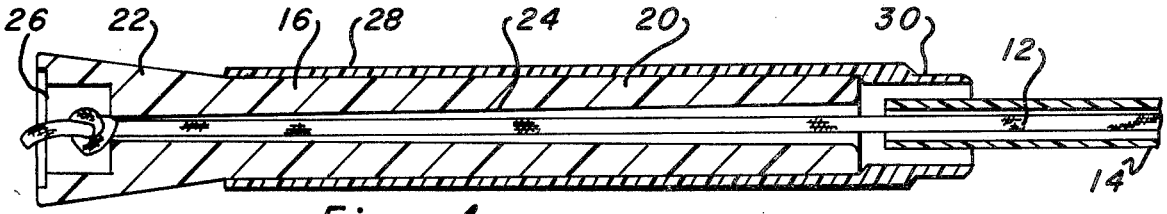
FIG. 4 is a cross-sectional view of the rope taken along the plane of line 4—4 of FIG. 1.
Figure 5:
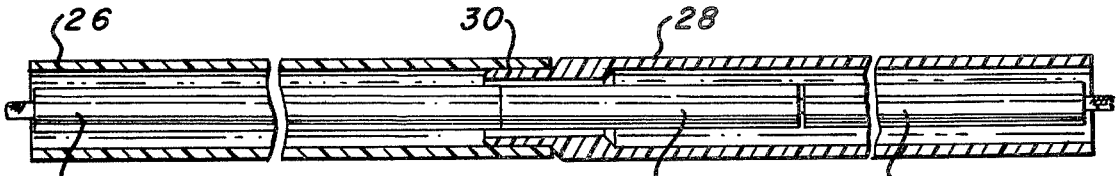
FIG. 5 is a cross sectional view of the rope taken along the plane of line 5—5 of FIG. 2.

As shown in FIGS. 3 and 4, the handles 16 have a cylindrical tubular portion 20 forming the majority of the handle length. The outer tip 22 of the handle has an increased diameter, preferably in the form of an axially outward flare. An axial bore 24 extends through the entire handle for the purpose of receiving core 12 therein. Cavity in tip 22 may house knot 18. The links 14 covering the majority of the length of rope 12 are preferably about two inches in length and of smaller diameter than the diameter of handle portion 20. For example, links 14 may have an outer diameter of five-sixteenths inch, while handle portion 20 has an outer diameter of one-half inch. The axial length of portion 20 may be four and one-quarter inches, while the axial length of flared tip 22 may be one and one-quarter inches. The broadest part of the flare may have a one inch diameter.

A handle portion 20 may be covered by an outer sleeve 26 having cylindrical form with a length slightly greater than the length of handle portion 20, for example four and three-quarters inches. The inner diameter of sleeve 26 is greater than the outer diameter of handle portion 20 or links 14, for example nine-sixteenths inch, while the outer diameter may be eleven-sixteenths or greater. As best shown in FIG. 3, sleeve 26 is retained from passing over the outer end of handle 16 by the flared tip 22, which is of greater diameter than the inner diameter of the sleeve 26.

The links 14 preferably are rigid or at least only mildly flexible, such that under the ordinary stress of rope jumping the links do not substantially bend but resist breaking when striking a floor. A soft plastic such as polyethylene may be used for these links. Handles 16 may be quite rigid so that they maintain their axially straight configuration even under the stress of being tightly gripped by a user. The handles may be formed from a styrene or ABS plastic. Sleeve 26, however, is preferred to be soft and flexible, such as a vinyl sleeve having approximately one-sixteenth inch wall. While the sleeve 26 is more flexible and softer than links 14, sleeve 26 will nevertheless resist bending due to the proportions of the sleeve.

With sleeve 26 covering handle portion 20, the diameter of the handle as gripped by a user is increased and, because of the softness of the vinyl sleeve, the handle acquires a resilient feel. The flexibility of the sleeve 26 allows its cylindrical wall to be compressed against handle portion 20, and natural friction between the surfaces of sleeve 26 and handle 16 further aid in maintaining the sleeve on the handle without any tendency to slip. However, when gripping force on the wall of sleeve 26 is released, the sleeve may be moved axially away from handle end 22 toward the center of the jump rope with little effort.

Figure 6:
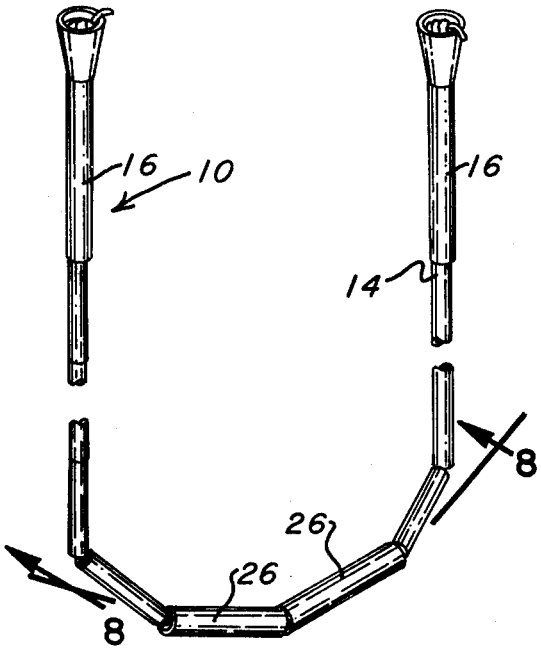
FIG. 6 is an isometric view of a modified embodiment of the rope.
Figure 8:
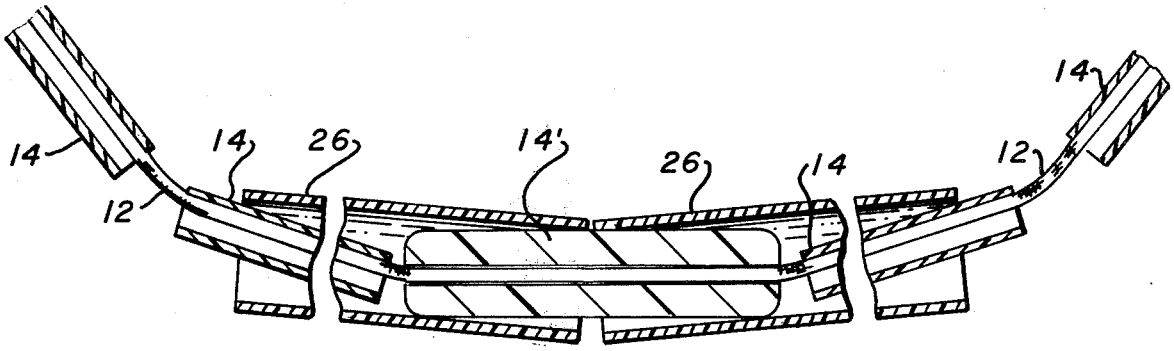
FIG. 8 is a cross-sectional view taken along the plane of line 8—8 of FIG. 6.

With reference now to FIGS. 6 and 8, it will be seen that a sleeve 26 is provided for each handle 16, and when both such sleeves have been moved toward the center of the jump rope, weight has been transferred to the center of the rope. In addition, each sleeve 26 overlaps portions of a plurality of links 14, creating substantially straight lengths in the center of the jump rope in excess of the length of an individual link 14 or sleeve 26. The exact configuration of the rope will vary according to the number of links 14 between the handles 16. If an odd number of links is present, the two sleeves 26 will mutually overlap the central link and therefore form a straighter central portion of the jump rope than if there is an even number of links and the sleeves are able to form a sharp angle at the contact junction between adjacent central links. An odd number of links is preferred in the embodiment of FIG. 6, allowing the least angle between sleeves 26 in the central position shown in FIG. 8.

In the embodiment of FIGS. 1–5, a sleeve 26 is supplied on only one end of the jump rope 10, while a sleeve 28 is supplied on the opposite end of the rope. Sleeve 28 is similar to sleeve 26 except that the axially inwardly facing end 30 of sleeve 28 has a reduced outer diameter that is slightly smaller than the inner diameter of sleeve 26, but larger than the outer diameter of links 14. End 30 extends axially inwardly of handle portion 20 and does not interfere with the positioning of sleeve 28 over the handle, but when the sleeves are moved to the center of the rope, the end 30 mates with the adjacent end of sleeve 26, maintaining the two sleeves along a straight axis regardless of whether an odd or even number of links 14 are found in the rope 10.

Figure 7:
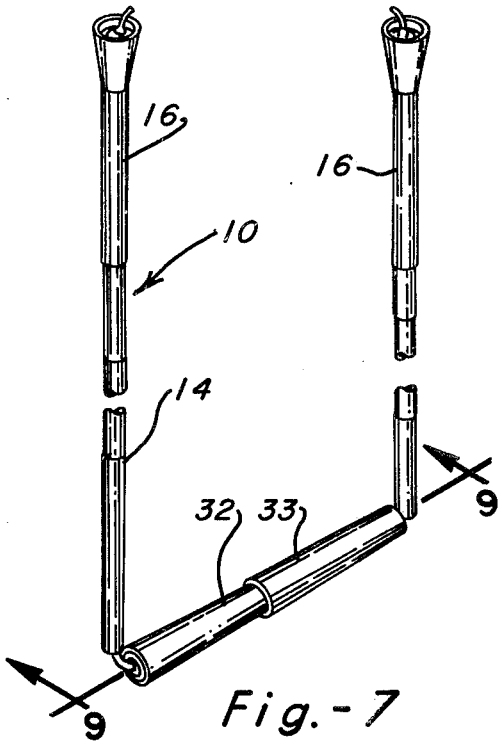
FIG. 7 is an isometric view of another modified embodiment of the rope.
Figure 9:
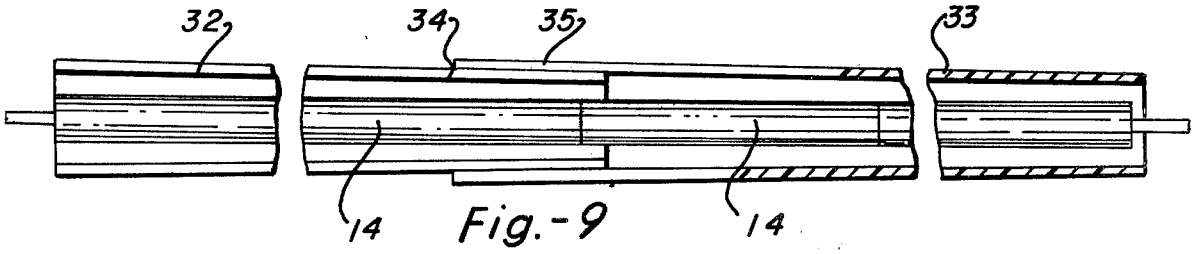
FIG. 9 is a cross-sectional view taken along the plane of line 9—9 of FIG. 7.

In a further modification shown in FIGS. 7 and 9, sleeves 32 and 33 are similar in size and material to sleeve 26, but sleeve 32 is radially inwardly tapered at its axially inward end 34, while sleeve 33 is radially outwardly flared at its axially inward end 35. End 34 thus mates with end 35 in socketed relationship, maintaining the two sleeves in axial alignment when in the center of the rope 10. Sleeves 32 and 33 may have a uniform diameter throughout their length, except at ends 34 and 35, respectively, in order to provide a uniform fit on handles 16. In the alternative, each sleeve may have a uniform flare or taper throughout its length such that a first end of either sleeve is the size of end 34, while the opposite end is the size of end 35, allowing sleeves 32 and 33 to be identical in structure but positioned on the rope 10 with the wide end of one sleeve facing the narrow end of the other sleeve.

In a further modification shown in FIG. 8, the straightness of the central part of the jump rope having sleeves 26 thereon can be improved by using central link 14' having length greater than the length of the remaining links 14. For example, when links 14 are two inches in length, link 14' may be three or four inches in length. The greater length of link 14' will interact with the inner side of sleeves 26 to reduce the resulting angle between the sleeves. Link 14' may also be of greater diameter than links 14 to produce a similar straightening between the sleeves, the exact degree of straightening being a function of the length and diameter of link 14' as related to the inner diameter of the sleeves 26. If link 14' is of greater diameter than links 14, the ends of the link may be rounded to avoid interference with the passage of the sleeve over the end of the link. A plurality of links 14' having greater length and/or diameter than links 14 may be used at the center of the jump rope if desired to achieve both greater straightness and greater central weighting.

In operation, a user places the sleeves 26, 28, 32, 33, as may be appropriate, over handle portions 20 at the start of exercise. The sleeves cushion the grip on the handle and provide a larger handle area. Flared handle end 22 acts as a stopper to prevent the handles from slipping out of the user's hands. When additional weight is desired at the center of the rope, the user may grasp the flared ends 22 with the third or fourth fingers and release gripping pressure on the sleeves, which will slide toward the center of the rope because of centrifugal force. There the sleeves will meet or mate, as the case may be.

In so doing, the sleeves also have the effect of slightly shortening the effective length of the rope, thereby changing the character of the jumping exercise in at least three distinct ways: first, the shorter effective length of the rope requires variation in the jumper's leg and arm motions to accomodate the change; second, the greater weight at the center of the rope alters the force required of the jumper's arm muscles; and third, the smaller resulting grip size changes the jumper's hand position. The straightened central portion of the rope has the further benefit of allowing the rope to be used in many indoor areas where low ceiling height would interfere with the swing of ropes having a normal central arc.

The relatively soft, flexible sleeves interact with the more rigid although mildly flexible links to straighten the central arc of the rope. Despite the flexibility of the sleeves or links individually, the combination of the sleeves over the links results in relatively greater stiffness that can maintain the central area of the rope in increased axial alignment. The sleeves therefore cause greater straightness when used with a segmented rope as described, as compared to a rope formed only from nonsegmented flexible cord.

Certain variations in the overall construction described above are possible without departing from the intended scope of the invention. Therefore, it should be understood that the described embodiments are intended to be by way of example and not limitation.

I claim:

1. An improved jump rope of the kind having a flexible core extending continuously between handles on each of the opposite ends of the rope to form the body thereof, and having a plurality of elongated tubular segments slidable over the core between the handles, the segments having substantially similar inner diameters for non-telescoping adjacent positioning along the length of the core, wherein the improvement comprises:

(a) each of said handles having an outer diameter larger than that of the tubular segments; and (b) first and second sleeves, one slidably mounted on each of said handles and covering a substantial portion of the handle for hand engagement with each said handle means on the outer end thereof to prevent the associated sleeve sliding off the outer end thereof, each sleeve having an inner diameter larger than the outer diameter of the handle for permitting the sleeves to be selectively slidable onto the body of the jump rope to positions near the center thereof over said tubular segments for centrally weighting the body of the rope, the length of each sleeve being greater than the length of each elongated segment for holding the segments in alignment through a portion of the body longer than the length of an individual segment.

2. The jump rope of claim 1, wherein each of said sleeves further comprises mating means for joining the sleeves in axial alignment when the sleeves are positioned near the center of the rope.

3. The jump rope of claim 1, wherein said first sleeve has an inner diameter of predetermined size and said second sleeve has an end portion of smaller diameter than said predetermined size for insertion into the end of the first sleeve.

4. The jump rope of claim 1, wherein said sleeves are constructed of a resilient material for cushioning the handles when the sleeves are mounted thereon and for retaining the sleeves on the handles through deformation under the pressure of being gripped, and wherein said handles extend for substantially at least the length of the sleeves.

5. The jump rope of claim 1, further comprising a central segment of said elongated body and a plurality of outer segments located relatively nearer the ends of the elongated body, wherein the central segment has a greater axial length than any of the outer segments for interacting with said sleeves when slidably moved to said positions near the center of the elongated body to hold the sleeves in improved axial alignment.

6. The jump rope of claim 1, further comprising a central segment of said elongated body and a plurality of outer segments located relatively nearer the ends of the elongated body, wherein the central segment has a greater outer diameter than any of the outer segments for interacting with said sleeves when slidably moved to said positions near the center of the elongated body to hold the sleeves in improved axial alignment.

7. The jump rope of claim 1, wherein said handles comprise a cylindrical grip portion having a flared end thereon, the handles being strung on the core with the flared ends at the outside extremes thereof, the grip portion of the handle having a greater outer diameter than said segments; and wherein said sleeves have an inner diameter greater than the diameter of said grip portions but smaller than the maximum diameter of the flared ends.

* * * * *